United States Patent [19]

Dawson

[11] Patent Number: 4,803,740

[45] Date of Patent: Feb. 14, 1989

[54] CLOTHING ADAPTOR FOR EARLY TERM PREGNANCY

[76] Inventor: Marisa Dawson, 601 Northwest 22nd St., Wilton Manors, Fla. 33304

[21] Appl. No.: 45,933

[22] Filed: May 4, 1987

[51] Int. Cl.[4] ..... A41D 1/14

[52] U.S. Cl. ..... 2/215; 2/221; 2/234; 2/237

[58] Field of Search ..... 2/215, 7.6, 234, 235, 2/237, 218, 219, 220, 221

[56] References Cited

U.S. PATENT DOCUMENTS

| | | | |
|---|---|---|---|
| 1,861,383 | 5/1932 | Ficcio | 2/227 |
| 2,747,197 | 5/1956 | Bailey | 2/221 X |
| 3,089,149 | 5/1963 | Kelleam | 2/221 |
| 3,431,562 | 3/1969 | Souders | 2/221 |
| 4,364,124 | 12/1982 | Barna | 2/234 |
| 4,389,733 | 6/1983 | Boykins | 2/234 X |
| 4,580,298 | 4/1986 | Tuisl | 2/237 |
| 4,683,595 | 8/1987 | Cash | 2/221 X |

*Primary Examiner*—Werner H. Schroeder
*Assistant Examiner*—Jeanette E. Chapman
*Attorney, Agent, or Firm*—M. K. Silverman

[57] ABSTRACT

Disclosed is a method of adapting a lower body garment for use during early term pregnancy. The method includes the steps of co-linearly securing to each side of the vertical zipper area, strips of a velcro-like fabric. Thereafter, there is provided an adaptor in the nature of an inverted triangle, formed of flexible fabric. Velcro-like strips are placed along both diagonal sides of the inverted triangle. There is further provided several buttons along the horizontal base of the adaptor at a first vertex thereof. There is also provided a buttonhole at the opposite horizontal vertex from the several buttons. The velcro-like strips co-linear with the zipper are press-fitted against the velcro-like elements upon the diagonals of the inverted triangle of the adaptor means. Thereafter a selected one of the several buttons is fastened to the original buttonhole of the lower body garment. The selected button of the several buttons will depend upon the point within the early term of pregnancy of the wearer. Thereafter, the buttonhole of said adaptor is fastened to the original button of the lower body garment.

2 Claims, 1 Drawing Sheet

CLOTHING ADAPTOR FOR EARLY TERM PREGNANCY

BACKGROUND OF THE INVENTION

The present invention relates to a removable insert intended to render regular clothing adaptable for wear during early term pregnancy and, after the period of pregnancy, to permit the return of the clothing to its original shape and utility.

Prior art efforts in the instant area, known to the inventor, include the following:

U.S. Pat. No. 2,606,322 (1952) to Vraciu, entitled Maternity Girdle, discloses a girdle having an insert which permits the usage of the girdle during different stages of pregnancy. The disclosure of Vraciu does not relate to any method for adapting ordinary clothing for use during the early stages of pregnancy.

U.S. Pat. No. 2,747,197 (1956) to Bailey, entitled Skirt with Removable Insert. This reference is not related to the maternity area; however, it discloses the use of an insert panel primarily for decorative purposes to an otherwise conventional skirt.

U.S. Pat. No. 2,873,452 (1959) to Jacobs, entitled Maternity Garment. This reference teaches the use of a permanently secured panel within a security garment to permit gradual increasing of the girth of the garment during the stages of pregnancy. Jacobs is strictly a maternity garment and is not applicable to use in regular clothing.

U.S. Pat. No. 3,089,149 (1963) to Kalleman, entitled Maternity Garment. This reference discloses a method for converting a maternity garment to use as a regular article of clothing, that is, a means for remodeling a maternity garment into a garment of normal shape and appearance. As such, the intent of this reference is precisely the opposite of Applicant's invention disclosed herein.

U.S. Pat. No. 3,099,014 (1963) to Smith, entitled Maternity Garment. This reference discloses a means of altering a regular garment for usage during different stages of pregnancy. This reference teaches a means that employs single, localized, alterations during each period of pregnancy; therefore its convenience is not the same as that set forth by Applicant herein.

Reference U.S. Pat. No. 3,431,562 (1969) to Souders, entitled Removable Maternity Insert Panels. This reference teaches the use of permanently inserted panels by which a regular garment may be converted into maternity usage.

As may be noted from the above, the prior art does not disclose a simple and convenient means for adapting a lower body garment for use during the early stages of pregnancy and, thereafter, a method permitting the garment to be returned to its original form and appearance without alteration. To this end the present invention is directed.

SUMMARY OF THE INVENTION

The present invention defines a method for adapting a lower body garment for use during early term pregnancy. The method comprises the steps of co-linearly securing, at both sides of a vertical zipper of such garments, strips of VELCRO-like fabric. Thereafter is the step of providing an adaptor means in the nature of an inverted triangle, formed of flexible fabric having strips of VELCRO-like elements along both diagonal sides of the inverted triangle. There is further provided a plurality of buttons along the horizontal base of said adaptor means at a first vertex thereof. There is yet further provided a buttonhole at the opposite horizontal vertex of the adaptor means. Said VELCRO-like elements, co-linear with the said zipper, are press-fitted against the said VELCRO-like elements upon the diagonals of said inverted triangle of said adaptor means. Thereafter a selected one of said plurality of buttons is fastened to the original buttonhole of the lower body garment. The selected button of said plurality of buttons will depend upon the point within the early term pregnancy at which the wearer is. Thereafter, said buttonhole of said adaptor is fastened to the original button of said lower body garment.

It is, accordingly, an object of the present invention to provide a simple and convenient means of adapting a normal wear lower body garment for use during early term pregnancy.

It is another object of the present invention to provide a method and means of the above type which will permit return of the garment to its original appearance and use after the instant adaptor has been removed.

It is a further object of the invention to provide a method and means of the above type which can be effected without need for alteration of the subject garment.

The above and yet other objects and advantages of the present invention will become apparent from the hereinafter set forth Detailed Description of the Invention, the Drawings, and the Claims appended herewith.

DETAILED DESCRIPTION OF THE INVENTION

Figure 1:
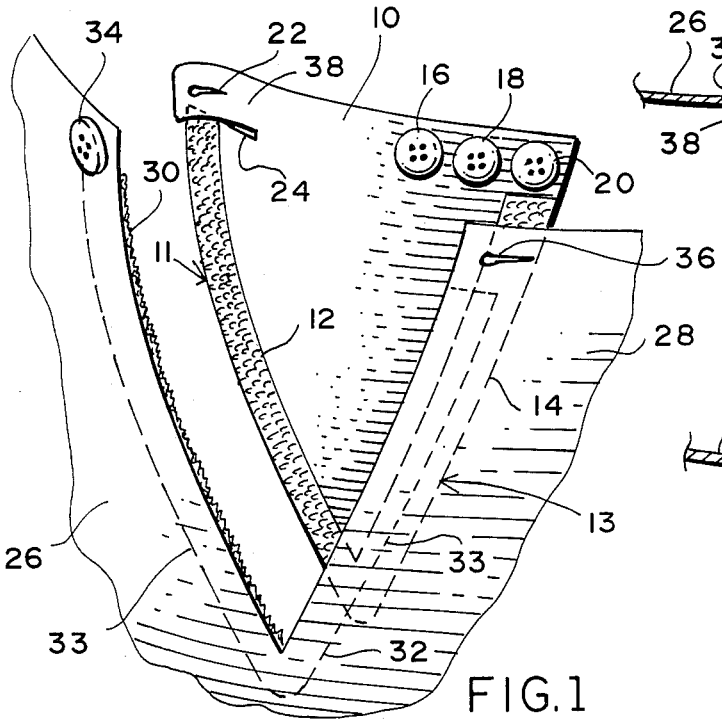
FIG. 1 is a perspective view of the inventive adaptor and a garment suitably modified for use in conjunction with said adaptor.

With reference to FIG. 1, there is shown adaptor 10 (the present invention), this being an adaptor for early term pregnancy. Said adaptor (see FIG. 1) comprises roughly the shape of an inverted triangle and is proportioned to the middle, lower, midriff of the user. Along one diagonal side 11 of said triangle of the adaptor is disposed a first strip 12 of loop VELCRO, this comprising the pile part of a hook and pile type fastener. Disposed along the right diagonal side 13 of adaptor 10 is a right strip 14 of loop VELCRO. Along the top of the triangle of adaptor 10 are three adaptor buttons 16, 18 and 20. To the left thereof is provided a lip element 38 containing therein button hole 22 and, at the lower edge thereof, cut 24, the function of which will be described below.

Figure 2:
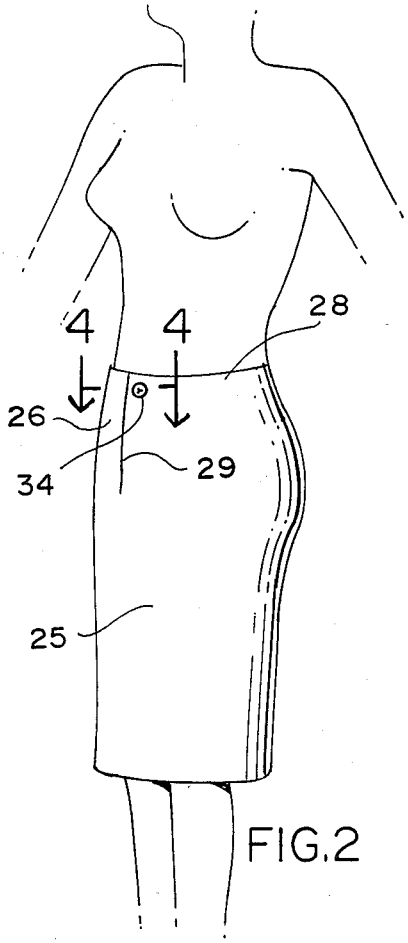
FIG. 2 is a perspective view of a user wearing a lower body garment prior to alteration.
Figure 3:
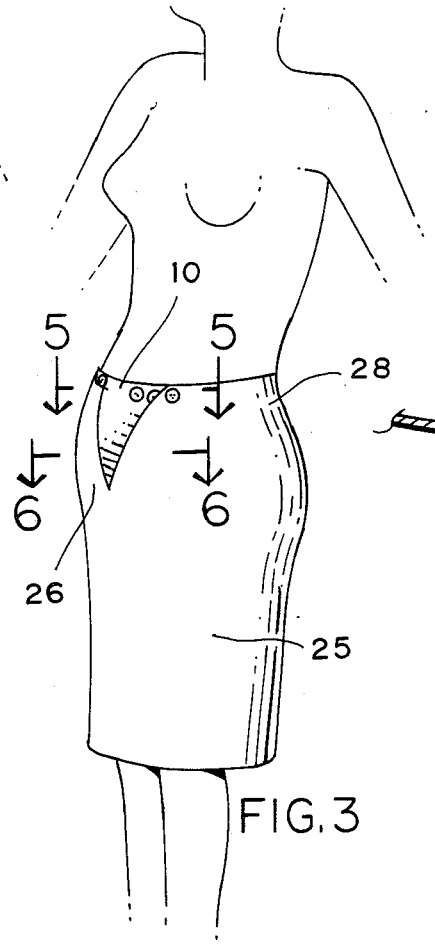
FIG. 3 is a perspective view of the inventive adaptor in use.

With reference to FIG. 2, there is shown a straight skirt 25 having a left side 26 and a right side 28, the left and right sides being separated by seam and zipper 29. It is to be appreciated that the instant invention is equally applicable to other female garments such as slacks and full skirts. Also, other closure means, apart from zippers, are applicable to the invention.

It may be appreciated that the view of FIG. 2 illustrates skirt 25 prior to insertion thereinto of the clothing adaptor.

Figure 4:
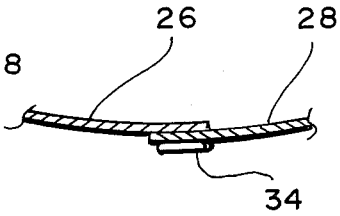
FIG. 4 is a top view taken along Line 4—4 of FIG. 2.

In the top view of FIG. 4 may be seen the pre-existing and prior art connection of left side 26 of the garment with right side 28 and the securement thereof by button 24.

Figure 5:
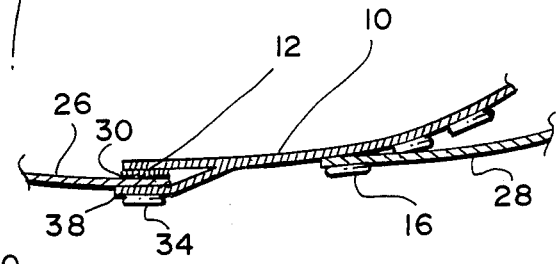
FIG. 5 is a top view taken along Line 5—5 of FIG. 3 however, showing a different button to buttonhole connection than that shown in FIG. 3.

To practice the present invention, the skirt 25 must be provided with hook VELCRO strips 30 and 32, these comprising the hook parts of hook and pile fasteners. See FIGS. 1 and 6. Such VELCRO strips may be readily glued, stapled or sewn into place as denoted by stitching 33 in FIG. 1. After VELCRO strips 30 and 32 are secured to sides 26 and 28, respectively, of garment 25, the garment is ready for use in conjunction with the inventive clothing adaptor. The method of interconnection between adaptor 10 and garment 25 is particularly shown in FIGS. 5 and 6. In FIG. 5, it may be noted that lip 38 of adaptor 10 may be moved freely as defined by the extent of cut 24. In use, lip 38 is bent forward in the direction of button 34 and then over button 34, such that, as shown on the left side of FIG. 5, button 34 may be placed through buttonhole 22. Beneath cut 24, loop VELCRO strip 12 mates with hook velcro strip 30.

Figure 6:
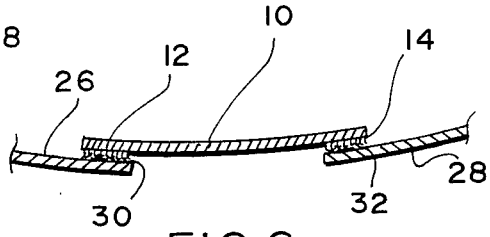
FIG. 6 is a cross-sectional view taken along Line 6—6 of FIG. 3.

At the right side of adaptor 10 (see FIGS. 1 and 5), one of said buttons 16, 18 or 20 is selected, depending upon the stage of pregnancy, and is secured through buttonhole 36. Regardless of which of said buttons, 16, 18 or 20 is selected, it will still be possible for right loop VELCRO strip 14 to mate with right hook VELCRO strip 32 as is shown in FIG. 6, in that it is not necessary that each strip completely cover its mating strip. Rather, a 50 percent overlap will be sufficient to keep the mating VELCRO pairs 12/30 and 14/32 in suitable secured contact with each other.

It is to be appreciated, that loop VELCRO strips 12 and 14 may be increased in width to further expand the ease of use of the instant invention.

It is expected that the above invention will prove most useful to women in their first to fourth month of pregnancy. After pregnancy, the garment may be readily returned to its original shape, shown in FIG. 2, by simply removing the adaptor and using the garment in a conventional fashion. If strips 30 and 32 prove irritating against the skin, they can be easily removed.

Accordingly, while there have been shown and described the preferred embodiment of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention, what I claim as new, useful and non-obvious and, accordingly, secure by Letters Patent of the United States is:

1. A method for adapting a lower body garment having in the midriff area a vertical waist fastening zipper, a fastening button and a corresponding buttonhole, which method is for use during early term pregnancy, said method comprising the steps of:

(a) securing, at both sides of said vertical zipper of said garment, strips of hook and pile type fastener fabric;

(b) providing an adaptor means in the nature of an inverted triangle, formed of a flexible fabric, with strips of hook and pile type fastener material along both diagonal sides of said triangle;

(c) providing a plurality of buttons along the horizontal base of said inverted triangle of said adaptor means at one vertex thereof;

(d) providing a buttonhole at an opposite vertex of the horizontal base of said adaptor means;

(e) press-fitting said velcro-like elements near said vertical zipper against said hook and pile type fastener material of said adaptor means;

(f) fastening a selected one of said plurality of buttons to said buttonhole of said lower body garment; and (g) fastening said buttonhole of said adaptor means to said button of said lower body garment, whereby a regular-use lower body garment may be adapted for use during early term pregnancy through the insertion thereinto of said adaptor means and the securement thereof to the lower body garment in accordance with Steps (e), (f), and (g) above.

2. An adaptor means for insertion into a lower body garment having in the midriff area thereof a vertically fastening zipper, a fastening button at the level of the waist, and a buttonhole complementary thereto, said means for use during early term pregnancy, the adaptor means comprising:

a plane of fabric having the shape of an inverted triangle proportioned generally to the center lower area of the midriff of a user, the adaptor means provided with strips of hook and pile type fasterner material along the diagonal sides thereof, said adaptor means further including a plurality of buttons along the horizontal base of said adaptor means at one vertex thereof, said adaptor further including a buttonhole at the horizontal base of said adaptor at the opposite vertex to the location of said plurality of buttons, whereby said adaptor means may be secured, thru said hook and pile type fastener material strips to oppositely disposed hook and pile type fastener material strips placed near said vertical zipper and upon the lower body garment at each side thereof and by press-fitting of opposing pairs of said velcro-like elements against each other, and the selective use of different of said plurality of horizontally-disposed buttons, said adaptor means may be employed to modify an otherwise normal garment for wear during early term pregnancy and, thereafter, returned to normal non-maternity use by the removal of said adaptor means.

* * * * *